United States Patent [19]

Daniel

[11] 4,103,531

[45] Aug. 1, 1978

[54] METHOD AND APPARATUS FOR CORRECTING BENT STRUT MISALIGNMENT

[76] Inventor: Danny O. Daniel, 230 N. 2nd, Pocatello, Id. 83201

[21] Appl. No.: 715,375

[22] Filed: Aug. 18, 1976

[51] Int. Cl.[2] ..... B21D 1/12

[52] U.S. Cl. ..... 72/380; 72/704; 72/386; 72/461

[58] Field of Search ..... 72/380, 386, 704, 705, 72/457–459, 388, 384

[56] References Cited

U.S. PATENT DOCUMENTS

| | | | |
|---|---|---|---|
| 1,775,968 | 9/1930 | Nelson | 72/705 |
| 1,869,905 | 8/1932 | Marsh et al. | 72/704 |
| 2,042,856 | 6/1936 | Merrill | 72/705 X |
| 2,069,249 | 2/1937 | Hunt | 72/705 X |
| 2,142,850 | 1/1939 | Johnston | 72/705 X |
| 2,256,231 | 9/1941 | Bender | 72/705 |
| 2,427,536 | 9/1947 | Simons | 72/704 |
| 2,491,117 | 12/1949 | Langham | 72/705 X |
| 2,664,063 | 12/1953 | Nakruski | 72/705 |
| 2,830,789 | 4/1958 | MacMillan | 72/705 X |
| 3,050,100 | 8/1962 | Liskey | 72/704 X |
| 3,481,176 | 12/1969 | Horn | 72/704 |

FOREIGN PATENT DOCUMENTS

| | | | |
|---|---|---|---|
| 39,785 | 1965 | German Democratic Rep. | 72/705 X |

*Primary Examiner*—C. W. Lanham
*Assistant Examiner*—D. M. Gurley
*Attorney, Agent, or Firm*—Berman, Aisenberg & Platt

[57] ABSTRACT

A method and apparatus for correcting misalignment resulting from a bent strut in a motor vehicle without requiring dismantling. The wheel support and alignment portion of a vehicle includes a wheel supporting hub, a wheel drum through which the hub extends and the strut which is connected between the hub and the frame of the vehicle. The technique comprehends the steps of holding the strut at a point adjacent the portion thereof to be bent, and applying a bending force to the portion of the hub which extends through the wheel drum. A wheel holding device is preferably connected to the wheel drum via the wheel's threaded bolts and lug nuts. The wheel holder has a horizontally extending thrust plate against which the piston of a jack is applied to push either upwardly or downwardly as the correction may require. An auxiliary U-shaped frame may be utilized to support the bending jack when a downward bending force is desired. Novel strut holders are provided to support the strut adjacent the position at which the bend is desired, and may include means for accommodating the ball joint and lower arm without doing damage thereto. Auxiliary clamping members, holding jacks and support members, including a movable base, may be provided in order to facilitate the alignment operation.

42 Claims, 19 Drawing Figures

FIG. 1.
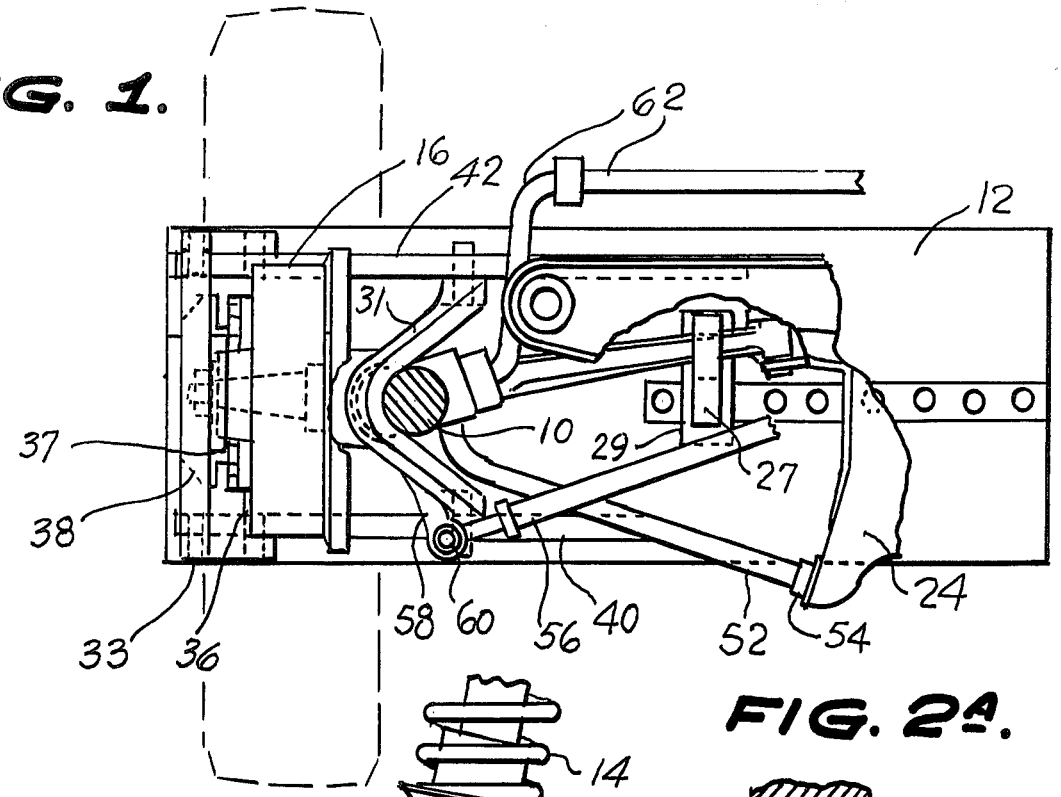
FIG. 2A.
FIG. 2.
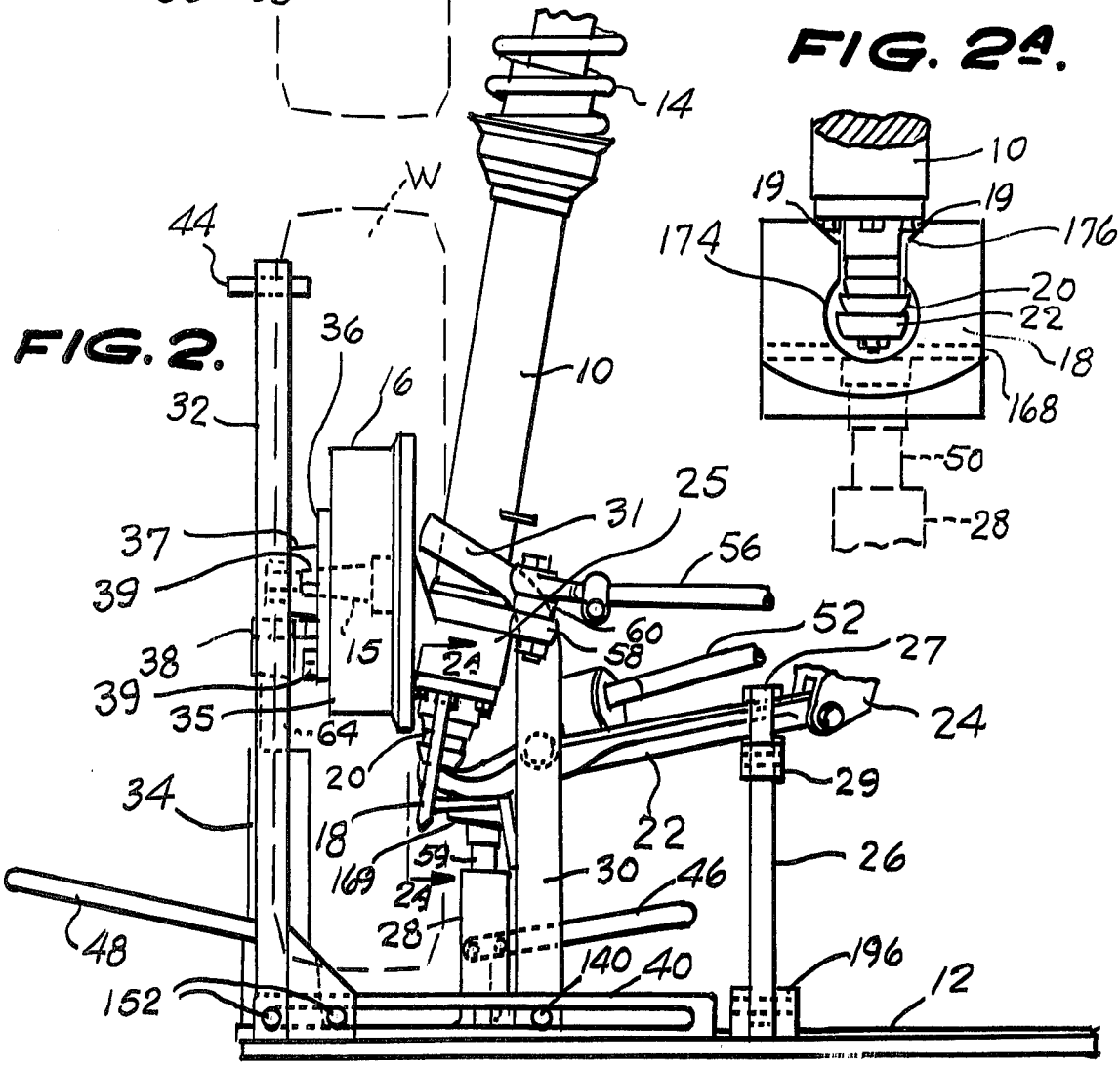

FIG. 6.
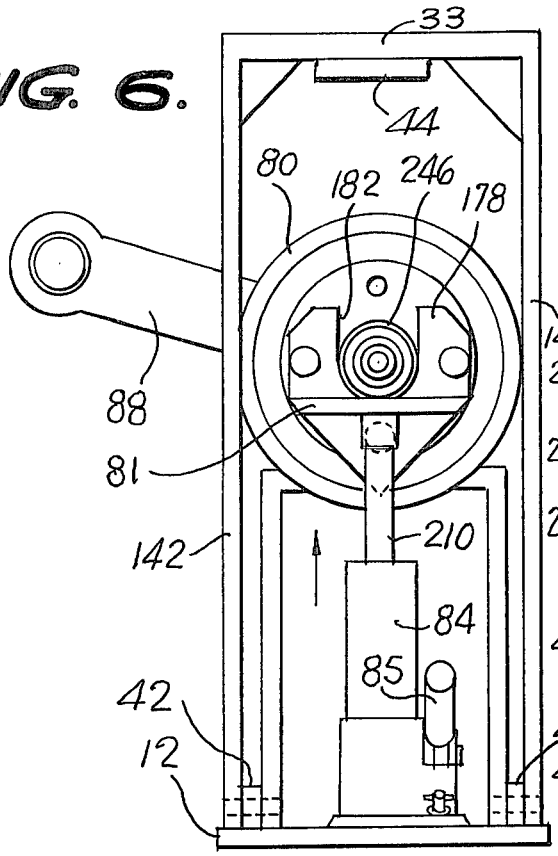
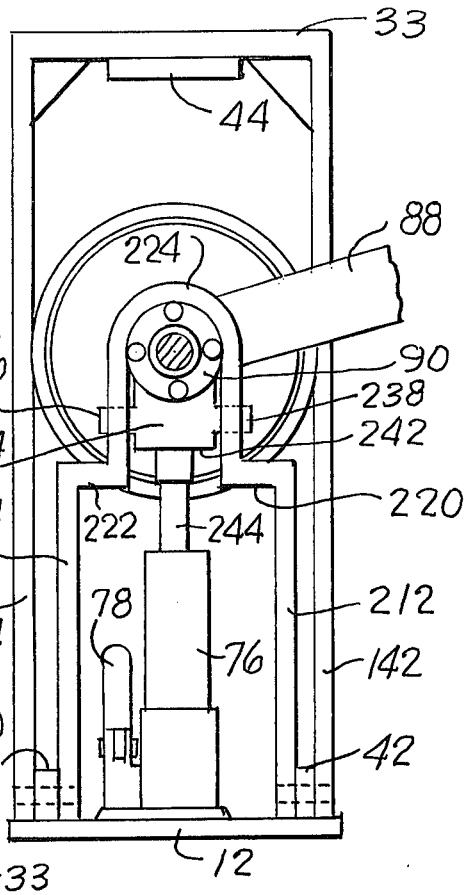
FIG. 7.
FIG. 8.
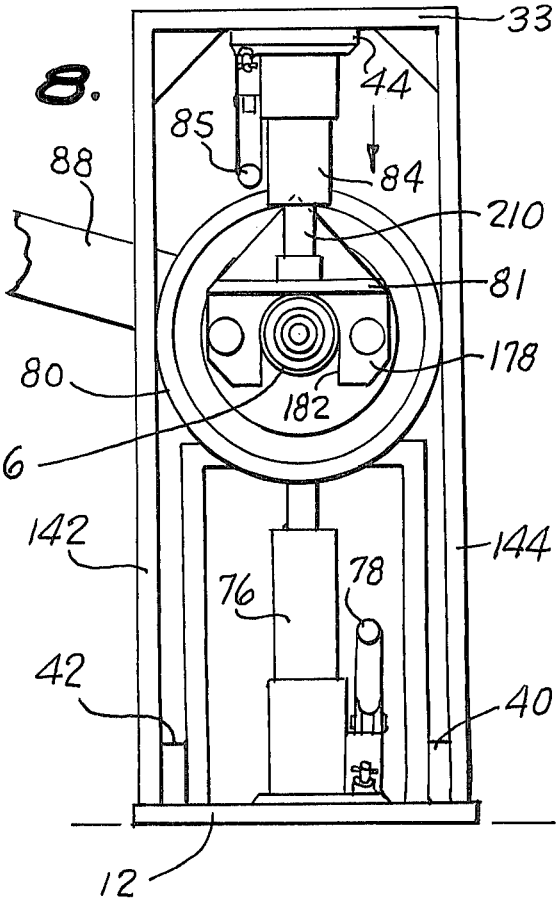
FIG. 9.
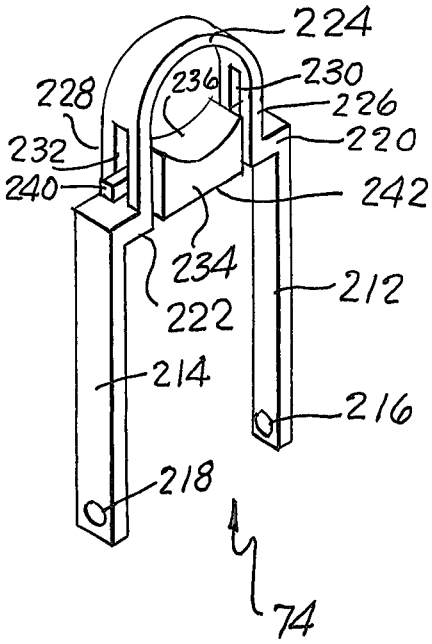

FIG. 15.
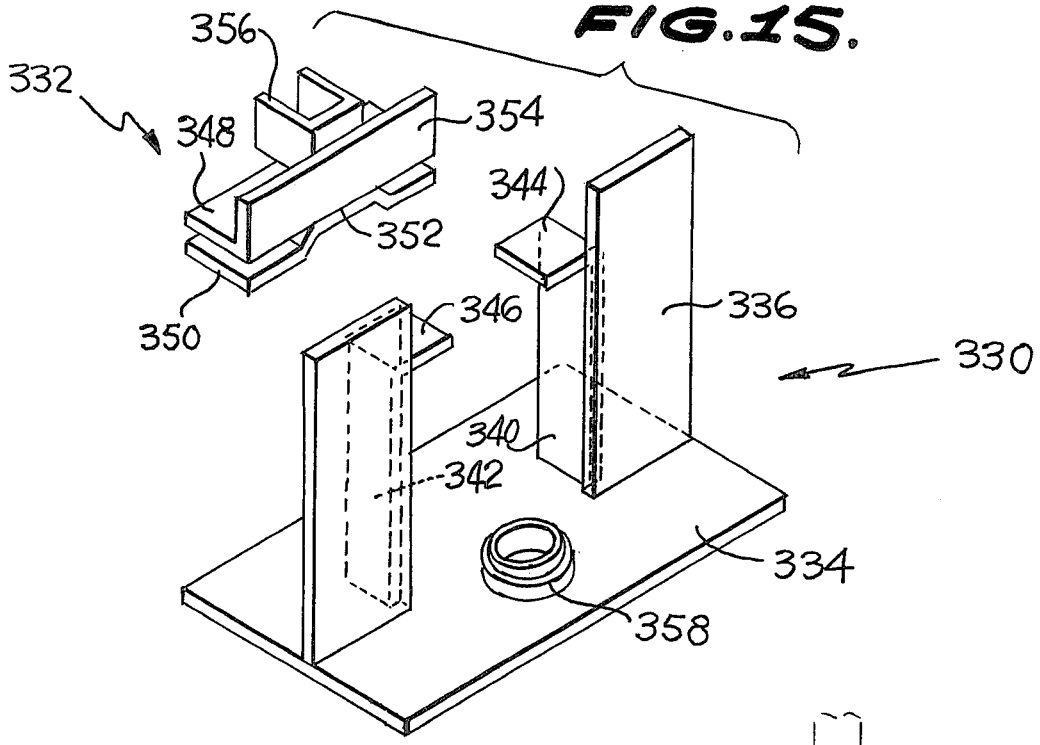
FIG. 16.
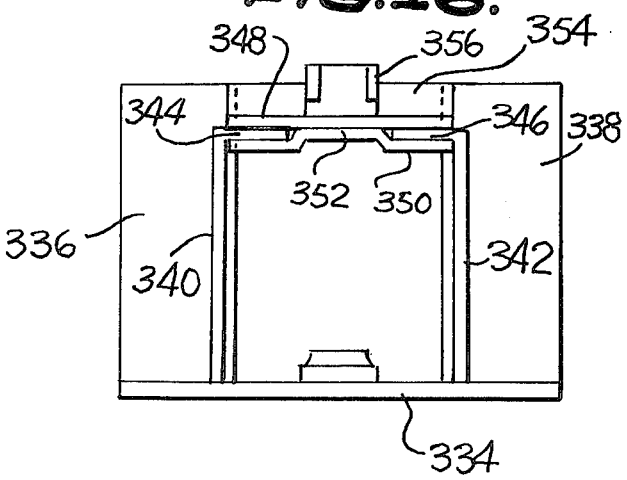
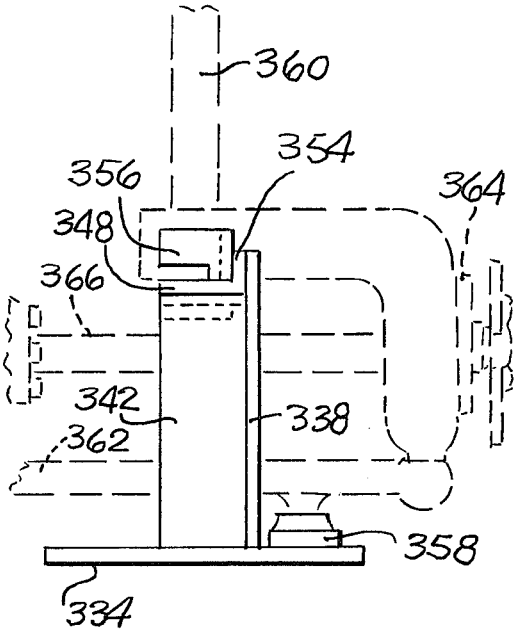
FIG. 17.

METHOD AND APPARATUS FOR CORRECTING BENT STRUT MISALIGNMENT

BACKGROUND OF THE INVENTION

1. Field of the Invention

The present invention is related to vehicle wheel alignment devices and techniques and, more particularly, is directed to a method and apparatus for correcting wheel alignment that results from misshapen or bent strut members.

2. Description of the Prior Art

Maintainance of wheel alignment is a well known requirement for maximizing safety and minimizing wear and tear on tires in automobiles and other motor vehicles. Conventional wheel alignment equipment, of which there are many designs, do not, however, allow for correction of certain types of alignment problems caused by bent or otherwise deformed front and rear end support elements or struts. Presently, when such struts or support members become bent or deformed, it is necessary to dismantle the front or rear end of the automobile, as the case may be, in order to remove the damaged part and either bend it back in shape or replace it. Since the cost of the part is not great, many car owners have chosen to replace bent struts rather than have them bent back into shape since presently available techniques require the same amount of labor for either replacement or repair. Thus, it is not surprising that many car owners choose to have new parts installed rather than repair the old ones, in spite of the fact that if bent back properly, the part can be made as good as new.

McPherson struts as installed in certain Datsun and Volkswagen automobiles are exemplary of the type of struts which presently are replaced in great numbers in order to correct bent strut wheel misalignment. It may be appreciated that, as a result of the great popularity of such automobiles, strut replacement or removal and repair can be quite costly to the car owner.

It is therefore apparent that a great need exists for a technique and apparatus which will permit bent strut misalignment to be corrected without requiring dismantling of the front or rear end of the automobile, and without requiring replacement of the bent or otherwise deformed part.

Such a technique would preferably allow the defective or deformed strut to be bent to achieve a proper degree of camber while remaining installed on the automobile without damaging other automotive parts, and requiring a minimum amount of time and labor.

Prior art United States patents of which I am aware which are in the field of the present invention include U.S. Pat. Nos. 3,777,542 and 3,765,219, neither of which would be appropriate for the purpose envisioned for the present invention.

OBJECTS AND SUMMARY OF THE INVENTION

It is therefore a primary object of the present invention to provide a novel and unique method and apparatus for correcting bent strut misalignment in motor vehicles which overcomes all of the disadvantages noted above with respect to prior art techniques and devices.

Another object of the present invention is to provide a method and apparatus for correcting automobile wheel alignment resulting from bent or otherwise deformed struts which can be performed without the need for dismantling the wheel alignment and supporting apparatus.

An additional object of the present invention is to provide a method and apparatus for correcting camber in the wheel alignment sections of a motor vehicle which correction requires bending of the struts of the automobile.

A still further object of the present invention is to provide a method and apparatus for bending the deformed struts of an automobile while same are installed thereon, without the necessity for dismantling the front or rear ends which can be performed in a minimum amount of time.

A still additional object of the present invention is to provide a method and apparatus for correcting the camber of an automobile that results from bent or otherwise deformed struts, which does not require replacement of the defective part, thereby saving considerable cost in both labor and parts.

It is another object of the present invention to provide a technique and device for permitting easy, accurate and rapid camber adjustment of either the front or rear ends of automobiles equipped with McPherson struts, and which can be performed in a minimum amount of time without replacement of parts to greatly reduce both the labor and part costs associated therewith.

Another object of the present invention is to provide a technique and device for bending the strut in either the front or rear end of certain automobiles, which technique can be performed without damage to the other delicate parts in the wheel supporting and alignment sections, and which can be accomplished quickly, easily, efficiently, and inexpensively.

The foregoing and other objects are achieved in accordance with one aspect of the present invention through the provision, in a vehicle having a wheel drum with threaded bolts projecting therethrough, a hub projecting through the drum, and a strut connected thereto, of an apparatus which comprises means for holding the strut, and bending means operatively connected to the wheel drum for bending the strut while installed in the car. The bending means preferably comprises wheel holder means coupled to the threaded bolts, and means for applying a force to the wheel holder means. In a preferred embodiment, the wheel holder means comprises a wheel plate member having apertures formed therein through which the threaded bolts may be secured, and thrust plate means extending substantially transversely to the wheel plate member for receiving the force applied by the force applying means. In one embodiment, to correct for negative camber, the force applying means comprises a jack positioned above the thrust plate, the jack having a piston for bearing downwardly against the thrust plate. In an alternative embodiment, to correct for positive camber, the force applying means comprises a jack positioned below the thrust plate, the piston of the jack bearing upwardly against the thrust plate.

In accordance with other aspects of the present invention, the strut holding means preferably comprises means contacting the lower portion of the strut for preventing downward movement thereof when correcting for negative camber. The contacting means preferably comprises bracket means having a cutout formed therein for fiting about the lower ball joint and lower arm of the automobile. A support jack is placed under the bracket means and includes a piston which extends to exert an upward supportive force on the bracket. More particularly the bracket means comprises a vertically oriented substantially flat plate in which the cutout is formed, the plate having a pair of upstanding ears positioned on each side of the cutout for contacting the lower portions of said strut, the bracket means further comprising a horizontally oriented support plate against the underside portion of which the piston of the support jack is positioned. In this instance, the force applying means comprises a second jack positioned above the thrust plate of the wheel holder means, the second jack having a piston for bearing downwardly against the thrust plate.

Means may also be provided for supporting the second jack above the thrust plate, and in a preferred embodiment comprises a horizontal brace member having arms extending downwardly from the ends thereof and being secured to substantially fixed base member. The second jack is inverted and has its base positioned on the underside of the horizontal brace.

When an upward force is desired to correct for an overly positive camber, the strut holding means comprises, in accordance with other aspects of the present invention, means contacting the lower portion of the strut for preventing upward movement thereof, which contacting means in turn comprises a substantially U-shaped bracket member having an upper inclined portion positionable about the lower portion of the strut, and a pair of downwardly depending leg portions that are preferably respectively secured to the substantially fixed base member.

A second clamping member may be secured between the distal end of the lower arm and the fixed base member in order to provide additional support and protection.

In accordance with still other aspects of the present invention, the strut holding means may comprise a clamping means positionable about the axle of the wheel for preventing both downward and upward movement thereof. The clamping means may comprise a substantially U-shaped jaw member having a pair of downwardly depending legs extending from the ends thereof, the pair of legs being affixed to a substantially planar fixed base member at their distal ends. The clamping means further comprises a concave clamp member and means for urging same upwardly so as to securely clamp the axle between the U-shaped jaw member and itself. In a preferred embodiment, the urging means comprises a jack positioned on the fixed base and having a piston which contacts the underside of the concave clamp member to urge same upwardly. In a refined embodiment, the concave clamp member includes a pair of flanges which extend laterally and outwardly therefrom so as to be guided within vertical apertures formed in the U-shaped jaw member so as to provide an adjustable guide means therefor.

In accordance with still other aspects of the present invention, I have provided a method of correcting misalignment in the wheel support and alignment portion of a vehicle, said vehicle including a wheel-supporting hub, a wheel drum through which the hub extends, and a strut connected between the hub and the frame of the vehicle. The technique contemplates correcting misalignment by bending the strut while on the vehicle and comprises the steps of holding the strut at a point adjacent the portion thereof to be bent, and applying a bending force to that portion of the hub which extends through the wheel drum. The force applying step includes the step of mounting a holding device onto the wheel drum and operating a jack means so as to exert pressure on the wheel drum holding device. The step of holding the strut at a point adjacent that portion to be bent preferably includes the steps of placing a strut clamping member underneath the strut around the lower ball joint and arm of the vehicle, and operating a jack so as to urge the strut clamping members upwardly against the strut, whereupon the jack means will be positioned so as to exert downward pressure on the wheel drum holding device in order to correct for negative camber.

To correct for positive camber, the holding step of the technique of the present invention includes the steps of placing a strut clamping member about the base of the strut and fastening the distal end of the strut clamping member to a substantially planar fixed base member. The jack means is them positioned so as to exert upward pressure on the wheel drum holding device.

In an alternative technique, which for example is utilized to straighten a Volkswagen rear support that extends to the axle of the vehicle, the holding step includes the steps of clamping the axle at a point adjacent the strut connection point against both upward and downward forces. Additionally, the axle is preferably further clamped at its distal end adjacent the motor position.

BRIEF DESCRIPTION OF THE DRAWINGS

Various objects, features and attendant advantages of the present invention will be more fully appreciated as the same become better understood from the following detailed description thereof when considered in connection with the accompanying drawings, in which:

FIG. 1 is a top view illustrating the various components of the front end of an automobile equipped with the type of strut which may be bent in accordance with the present invention, illustrating the various components of the present invention in a simulated bending operation;

FIG. 2 is a front view of the same components illustrated in FIG. 1;

FIG. 2A is an enlarged view illustrating in more detail certain of the elements illustrated in FIG. 2 and taken along line 2A—2A thereof;

FIG. 6 is an end view of the components illustrated in FIG. 5;

FIG. 7 is a part-sectional part plan view illustrating certain of the components illustrated in FIG. 5 and taken along line 7—7 thereof;

FIG. 8 is a view similar to that of FIG. 6 but illustrating the position of the components in yet another alternative simulated operation;

FIG. 9 is a perspective view of a preferred embodiment of one of the clamping members utilized in conjunction with the present invention illustrated in FIGS. 4 through 8;

FIG. 15 illustrates in an exploded perspective view a two-part strut holder component which may be utilized for certain automobiles in accordance with the present invention;

FIG. 16 is an end view of the assembled components illustrated in FIG. 15;

FIG. 17 is a side view illustrating the assembled components shown in FIG. 15.

DETAILED DESCRIPTION OF THE PREFERRED EMBODIMENTS

Figure 3:
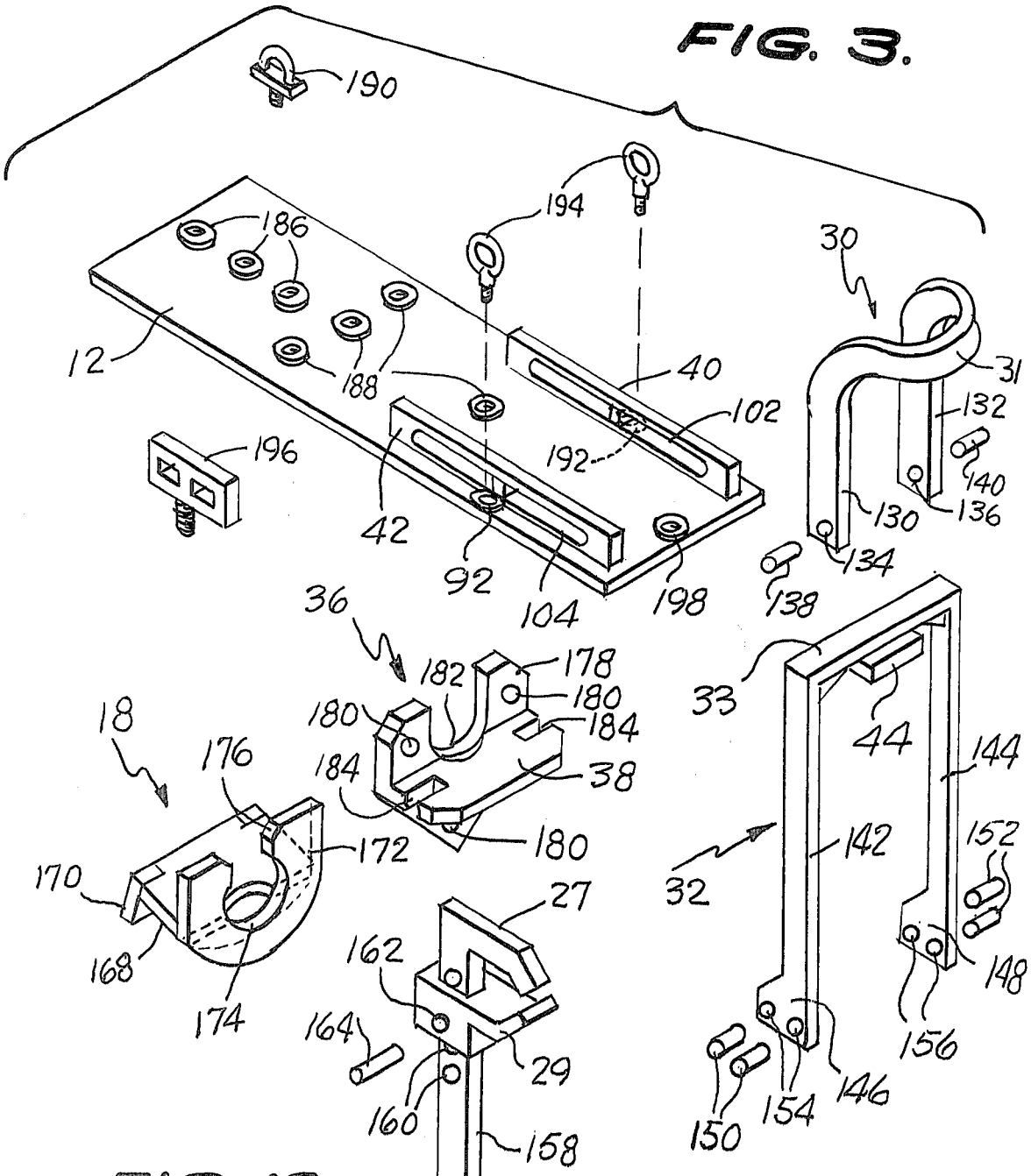
FIG. 3 is an exploded perspective view illustrating the components of the present invention utilized in conjunction with the simulated operation illustrated in FIGS. 1 and 2.

Referring now to the drawings, wherein like reference numerals represent identical or corresponding parts throughout the several views, and more particularly to FIGS. 1 and 2 thereof, there is illustrated in top and side plan views the components of the present invention operatively connected to the wheel support and alignment portion of a motor vehicle preparatory to the performance of the bending technique in accordance with the present invention.

While the method and apparatus of the present invention may be applied to any of a large number of automobiles, it will be described in connection with FIGS. 1 and 2 as utilized to bend what is known in the art as a McPherson strut which is indicated generally in FIGS. 1 and 2 by the reference numeral 10. The McPherson strut 10 is essentially comprised of a cylindrical tube within which is disposed a shock absorbing means, as will be apparent to a person of ordinary skill in the art. By way of example, and in order to facilitate the explanation of the operation of the present invention, McPherson strut 10 is shown as it is mounted in the front end of a Volkswagen automobile, although it should be understood that the same technique may be applied to McPherson struts mounted in other automobile wheel alignment and support structures, such as Datsun automobiles and the like, as will suggest themselves to a skilled mechanic.

Strut 10 has a coiled spring 14 positioned at the top portion thereof, and is connected at its bottom portion to a lower arm 22 by means of the lower ball joint 20. Lower arm 22 is, in turn, coupled to the frame of the automobile 24.

Extending integrally from and substantially transversely to the vertical axis of McPherson strut 10 at a position just above the lower ball joint 20 is a horizontally disposed hub 15 which extends through a suitable aperture formed in the wheel drum 16 of the automobile, all of which is conventional. The hub 15 includes an enlarged outer portion 37 that extends beyond the substantially vertical planar surface 35 of the wheel drum 16, as illustrated in FIG. 2.

Hub 15 extends from a cylindrical ring member 25 formed about the lower portion of McPherson strut 10 in a tight fitting integral manner.

To complete the description of the Volkswagen's conventional front end components, FIGS. 1 and 2 include a torsion bar 52 which is connected to the frame 24 of the automobile via a connector 54. Extending from the strut 10 is a tie rod arm holder 58 which is coupled to the steering tie rod arm 56 at a ball joint 60. The front end finally includes a front sway bar or stabilizer 62 for the lower control arm, all of which is conventional.

The remaining components illustrated in FIGS. 1 and 2 are utilized in connection with the technique and apparatus of the present invention and include a base member 12 upon which may be mounted a lower arm clamp 26, a strut clamp 30, and/or a U-shaped jack support member 32.

As illustrated more clearly in FIG. 3, base member 12 includes a pair of side support members 40 and 42 which extend longitudinally near the front end thereof in substantial parallel alignment. Side support members 40 and 42 each have a longitudinal slot 102 and 104, respectively formed therein for supporting the strut clamp 30 and/or the U-shaped jack support member 32. A pair of threaded apertures 192 may be disposed one on either side of the outer periphery of side support members 40 and 42, as illustrated in FIG. 3, for threadably receiving a pair of annular holding rings 194 therein. The base 12 may be provided with a plurality of additional threaded apertures 186 and 188, disposed at convenient predetermined locations, for threadably receiving other ringed holding elements, such as elements 190 and 196. Elements 190 and 196 assist in the clamping and/or holding functions of the base 12 and may be utilized, for example, as a support for chains or other holding means.

Figure 18:
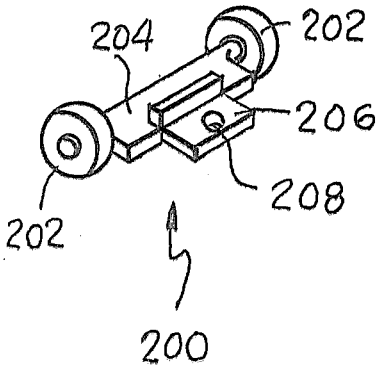
FIG. 18 is a perspective view illustrating an auxiliary attachment which may be utilized in connection with the base member illustrated in FIG. 3 in accordance with the teachings of the present invention.

At the forward end of base 12 may be located an aperture 198 within which a wheel assembly 200 may be mounted, the latter being more clearly illustrated in FIG. 18 to which attention is now directed. The wheel assembly 200 comprises a pair of wheels 202 which are journaled in a housing 204 having a forwardly projecting flange 206 that has a vertically disposed pin-receiving aperture 208 formed therein for mating with the aperture 198 formed in the forward portion of base 12, as described above.

It therefore may be appreciated that base 12 of the present invention may be provided in any of a number of equivalent configurations which may be suitable for the present invention, the present design intending to facilitate the technique in conjunction with the particular automobiles illustrated by way of example.

Still referring to FIG. 3, the strut clamp 30 is seen to include a curved inwardly extending U-shaped portion 31 from which downwardly depend a pair of substantially parallel and vertically oriented side support members or legs 130 and 132. A pair of mounting apertures 134 and 136 are formed in the lower portion of legs 130 and 132, respectively, for receiving mounting pins 138 and 140 therein. The mounting pins 138 and 140, or equivalents, secure the leg portions 130 and 132 of clamp 30 to the respective apertures 104 and 102 of side support members 42 and 40 of base 12.

Still with reference to FIG. 3, the U-shaped jack support member 32 is seen to comprise a pair of downwardly extending substantially vertical side support members or legs 142 and 144 which terminate in a pair of widened base portions or mounting flanges 146 and 148 which respectively have positioned therein mounting apertures 154 and 156 for receiving mounting pins 150 and 152, respectively. Similar to clamp 30, jack support member 32 may be mounted to side support members 40 and 42 by suitable positioning of pins 150 and 152 or equivalents, through the apertures 154 and 156 and horizontally disposed slots 104 and 102.

The jack support member 32 includes an upper horizontally disposed cross post 33 which has a top jack support 44 connected to the underside thereof, at approximately its mid-point, the purpose of which will become more clear hereinafter.

Still with reference to FIG. 3, the lower arm clamp 26 is seen to include a substantially vertical arm 158 which has a pin receiving mounting aperture 166 formed in the lower portion thereof. From the top of vertical arm 158 extends an integrally formed upper jaw 27. Clamp 26 further comprises a movable jaw member 29 which has an aperture vertically formed therein to permit vertical movement along arm 158. A locking pin 164 cooperates with an aperture 162 formed in lower jaw 29 and with one from amongst a plurality of apertures 160 formed in vertical arm 158 in order to set the position of lower jaw 29 as desired.

Still with reference to FIG. 3, the present invention includes a strut holder 18 which is generally designed to provide a support for the lower portion of strut 10 without damaging the delicate ball joint or lower arm connections thereof. To this end strut holder 18 is formed of three substantially planar, platelike sections. A pair of jack supporting sections 168 and 170 are connected at substantially right angles to one another and may include a wedged-shaped support 169 attached to the junction thereof as seen in FIG. 2. Extending upwardly from the jack supporting plate 168 is a substantially vertically oriented strut supporting section 172 having a ring-shaped cutout 174 which is shaped so as to fit around the lower arm 22 and a lower ball joint 20, as clearly illustrated in FIG. 2A. The ring-shaped cutout 174 is notched as at 176 for bearing against the nuts 19 which extend downwardly from the lower end of strut 10 (FIG. 2A). The purpose of this design will become more clear hereinafter.

The present invention further includes a device which may be attached to the wheel drum 16 and is referred to hereinafter as a wheel holder which is indicated generally by the reference numeral 36 in FIGS. 1, 2 and 3. Referring to FIG. 3, wheel holder 36 is seen to comprise a substantially planar wheel attachment plate 178 which has formed therein a plurality of mounting apertures 180. Plate 178 further has formed an opening 182 for receiving the hub extension 37. It will become more clear hereinafter that the actual shape of wheel holder 36, including the spacing of apertures 180 and the position of hub opening 182, may be varied according to the particular model of automobile upon which it is desired to practice the principles of the present invention.

Wheel holder 36 further has a plate member 38 horizontally extending therefrom which comprises a pair of parallel substantially planar upper and lower surfaces. Plate member 38 may also include one or more notches 184 for accomodating auxiliary holding members such as chains or the like.

Referring back to FIG. 2, a pair of suitable jacks are further provided to assist as holding and bending means in the effectuation of the technique of the present invention. A holding jack 28 includes an actuating arm 46 and a vertically extendable piston 50 which contacts the wedge 169 of strut holder 18 so as to provide a vertical support therefor.

A strut bending jack 34 includes an arm 48 for actuating same and a vertically extendable piston 64 which, in the illustrated set-up, bears on the underside of the horizontal thrust plate 38 of wheel holder 36.

In explaining the operation of the present invention, it will be presumed that the wheel W mounted to the wheel drum 16 has a slight positive camber as a result of a bent or otherwise deformed strut 10. Positive camber implies that the upper portion of the wheel W is slightly to the left of center position as illustrated in FIG. 2. In order to correct this overly positive camber, it is desired to bend the strut 10 at its lowermost portion, just above the cylindrical support 25 of hub 15.

After determining that corrective action is necessary, the front end of the car is first jacked up in the usual fashion, and the wheel W is removed. The base 12 is positioned underneath the correct side of the front end having the strut end desired to be bent.

For this particular bending correction, strut clamp 30 is then positioned about the lower portion of strut 10 such that the curved inwardly extending U-shaped clamping portion 31 thereof defines the point of stress or bend desired in the lower portion of strut 10. The bottom legs of strut clamp 30 are then firmly secured to side supports 40 and 42 by the pins 140 and 138.

The lower arm clamp 26 is then placed about the distal end of lower arm 22 adjacent to frame 24 in order to provide an upper and lower clamp therefor. Clamp 26 has its upper jaw 27 and lower jaw 29 firmly secured about lower arm 22, the bottom portion of clamp 26 being firmly attached to base 12, as by means of clamping member 196 (FIG. 3).

The wheel holder 36 is then fastened to the outer surface 35 of wheel drum 16 as by tightening the lug nuts 39 about the conventional threaded bolts extending through the wheel drum 16. After the wheel holder 36 is firmly secured to the drum 16, and hence to the hub 37, its thrust member 38 is disposed horizontally just below hub 37 in the manner illustrated in FIG. 2, and the piston 64 of jack 34 is raised by actuating handle 48 so as to contact the lower planar surface of thrust member 38.

Further application of force to the underside of thrust member 38 will bend the hub 37, hub 15, and hence strut 10 at the point of stress defined by the positioning of the clamping portion 31 of strut clamp 30. The degree of bending of strut 10 at the point of stress defined by the engagement of the lower end thereof by the curved inwardly extending U-shaped clamping portion 31 may be monitored at selected intervals, in the judgment of the mechanic, by conventional gauges in order to assure the proper correction.

If it is desired, on the other hand, to correct an overly negative camber in the front end set-up of FIGS. 1 and 2, it becomes necessary to support the lower portion of strut 10 such that a downward push may be effectuated upon hub 37 and, hence the lower portion of strut 10 to bend same. That is to say, if the top portion of the wheel W is to the right of the vertical center line (negative camber), and it is desired to bring same to the left in order to create a positive camber, the same basic components described above are utilized along with strut holder 18 and U-shaped jack support member 32.

In operation, after the vehicle is jacked up, the wheel is removed, the base 12 is positioned, and the strut holder is placed about the lowermost portion of strut 10 (FIG. 2A) such that its notched portions 176 positioned on either side of the ring shaped cutout 174 contact the bottom projecting nuts 19 of the strut 10. Note that the cutout 174 is sufficiently large so as to accomodate the lower ball joint 20 along with the connecting portion of lower arm 22 therein. The jack 28 is then placed in position underneath the holder 18. Arm 46 of jack 28 is actuated to raise its piston 50 to contact the wedge platform 169 on the underside of strut holder 18. The design of the strut holder 18 is such that the entire force presented by jack 28 is placed upon the nuts 19 of strut 10 without contacting the lower ball joint 20 or lower arm 22. This design is essential in order to prevent any pressure from being applied to those very sensitive and delicate parts.

Strut clamp 30 is then positioned about the lower portion of strut 10 where the bend is desired and is fastened in the lower side supports 40 and 42 as described above. The lower arm clamp 26 is likewise positioned and clamped in the same fashion as described above, and the wheel holder 36 is fastened to the wheel drum 16. At this point, however, the thrust plate member 38 of wheel holder 36 is rotated along with the drum 16 so as to rest horizontally but above hub 37.

The U-shaped jack support member 32 is then secured in position by clamping its respective base members 146 and 148 to the base side support members 42 and 40 via mounting pins 150 and 152.

The strut bending jack 34, instead of being positioned in the fashion illustrated in FIG. 2, is then placed in a substantially inverted position such that its base rests upon the top jack support 44 connected to the lower side of cross-post 33 of jack support member 32.

When the jack 34, thus positioned, is actuated, its piston 64 will push downwardly on the horizontal thrust plate 38 to essentially bend hub 37, hub 15 and connected strut 10 in response thereto. Note that the lower portion of strut 10 is firmly supported against downward movement by means of strut holder 18 and associated jack support 28, and the entire lower arm 22 is further supported by means of clamp 26. The downward force will therefore result in the desired degree of bending about the stress point defined by the juxtaposition of clamping portion 31 to strut 10. Again, the degree of bending may be monitored by conventionally available gages until the desired alignment has been achieved.

By virtue of the above-described procedures and apparatuses, the strut 10 may be bent from either a positive to a negative camber, or vice-versa, without dismantling the wheel support and alignment structure, and without requiring a great deal of time.

Referring now to FIGS. 4 through 9, another and alternative form of the invention is illustrated which may be utilized, by way of the examples shown, to effectuate proper alignment in the rear end of a Volkswagen automobile by essentially twisting or bending the rear support or strut thereof, which rear support or strut is indicated generally by the reference number 66.

Figure 4:
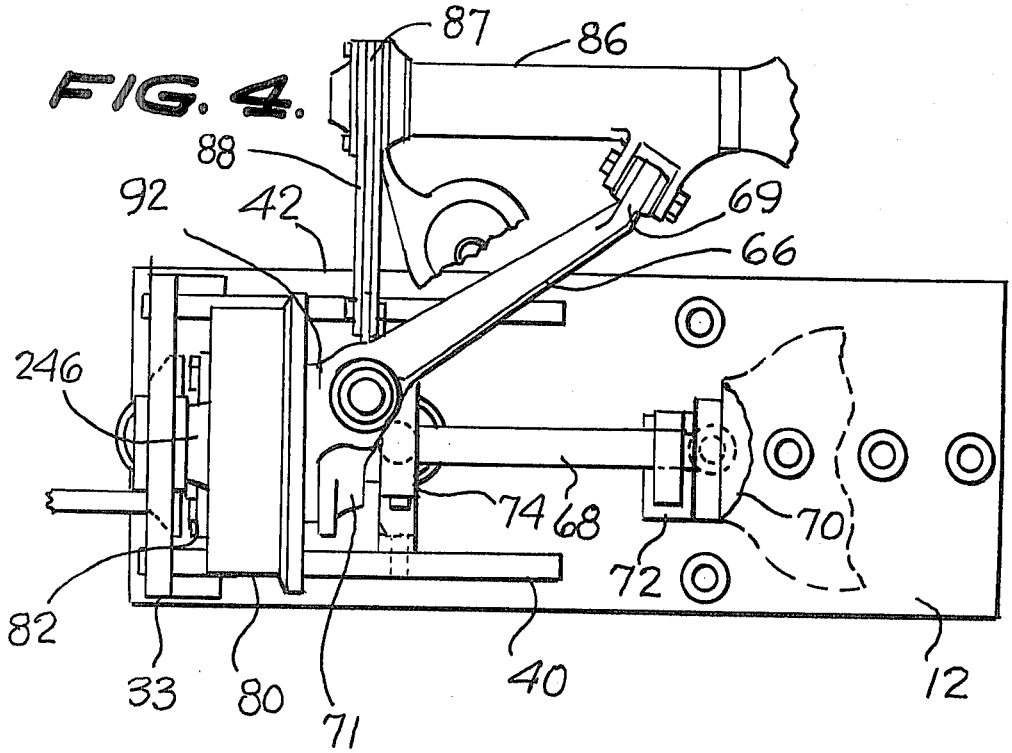
FIG. 4 is a top, plan view of an alternative simulated operation of the present inventive technique on the rear end of yet another automobile.
Figure 5:
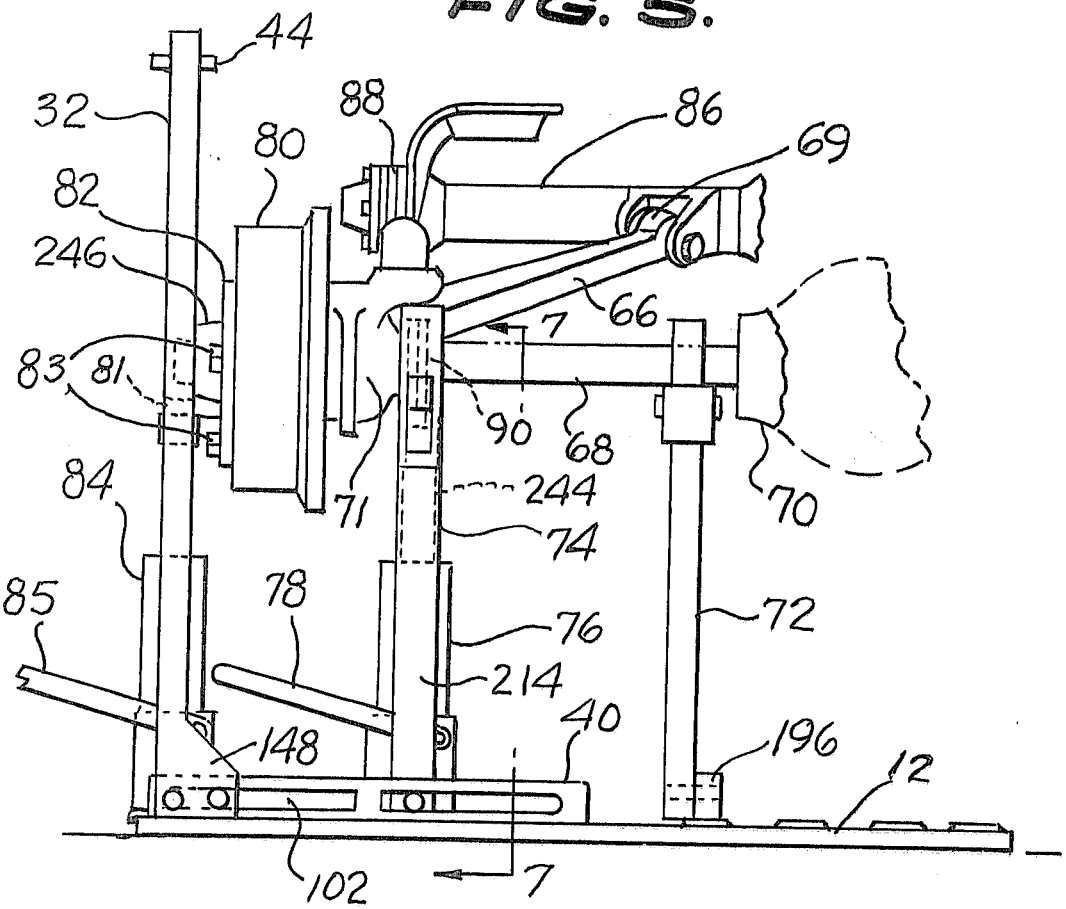
FIG. 5 is a frontal, plan view of the components illustrated in FIG. 4.

Referring more particularly to FIGS. 4 and 5, strut 66 is seen to be comprised of a rearwardly and angularly extending support member whose rear end 69 is coupled to the frame 86 of the automobile as illustrated. The forward end 71 of strut 66 is comprised of a disc-like member which is coupled via a velocity bearing 90 to the rear axle 68 of the automobile. The other side of the the disc-like front end 71 is coupled to the wheel drum 80 through which extends the hub 246 of the rear axle 68. The distal end of axle 68 is coupled to a conventional rear-mounted motor 70 of the Volkswagen automobile.

Extending rearwardly and somewhat upwardly from the frontal portion 71 of strut 66 is a leading support member 88 which is also coupled to the car frame 86 as at 87.

In this particular embodiment, a single clamping means 74 is utilized to provide both upward and downward clamping action for the strut 66. Clamp 74 is illustrated in more detail in FIG. 9, to which attention is now directed and is seen to comprise a pair of substantially parallel upstanding support legs 212 and 214 having mounting apertures 216 and 218 formed in the bottom portions thereof. At the top of legs 212 and 214 are integrally formed inwardly extending support members or arms 220 and 222 at the distal ends of which are connected the ends 226 and 228 of an inverted U-shaped rigid jaw member 224.

Formed in the substantially linear ends 226 and 228 of jaw member 224 are a pair of vertical slots 230 and 232 which accommodate respectively a pair of flanges or ears 238 and 240 of a lower movable jaw member 234. Jaw member 234, in addition to ears 238 and 240, has a concave clamping surface 236 formed at the upper portion thereof and a substantially planar bottom surface 242.

Referring back to FIGS. 4 and 5, the rigid jaw member 234 is placed about the top portion of the velocity bearing 90 and the arms 212 and 214 are secured in their respective side support members 42 and 40, respectively. A holding jack 76 is then positioned underneath the movable jaw member 234 such that its piston 244 bears upwardly against the bottom surface 242 thereof (See FIG. 7). Handle 78 of holding jack 76 is then actuated to urge lower movable jaw member 234 upwardly until clamp 74 is firmly seated about the velocity bearing 90 so as to prevent damage thereto during the ensuing bending operation.

An auxiliary axle clamp 72, whose construction is analogous to the lower arm clamp 26 of FIGS. 1 and 2, is then positioned about the distal end of axle 68 adjacent its connection to motor 70, the lower portion of clamp 72 being secured to the base 12 via a holder such as at 196.

A wheel holder 82 is then secured to the wheel drum 80 in much the same fashion as described in connection with the first embodiment. In fact, for these two particular makes and models of automobiles, wheel holder 82 may be substantially equivalent to the wheel holder 36 described in connection with the embodiment illustrated in FIGS. 1 through 3. Wheel holder 82 has an opening formed therein through which hub 246 extends and may be mounted to wheel 80 via conventional lug nuts 83.

If it is desired to correct an overly positive camber to a negative camber, the horizontal thrust plate 81 of wheel holder 82 is positioned as illustrated below hub 246. A bending jack 84 having an actuating handle 85 and a piston 210 (See FIG. 6) is then placed in position underneath holder 82 and piston 210 is urged upwardly to contact the horizontal plate 81. Application of further force by jack 84 on thrust plate 81 will bend or twist the strut 86 at a point 92 positioned between the leading support 88 and the drum 80 as illustrated best in FIG. 4. This twisting will result in a more negative camber being imparted to this particular wheel support assembly until the desired degree is obtained as may be measured by conventional instruments.

If, on the other hand, it is desired to correct a negative camber to a more positive camber, the set-up illustrated in FIGS. 4 through 7 is modified by the addition of the U-shaped jack support member 32 against the upper support 44 of which is placed the base of bending jack 84, as clearly illustrated in FIG. 8. Also, wheel drum 80 is rotated until the thrust plate 81 lies above the hub 246, legs 142 and 144 of jack support member 32 having been secured to base side support members 42 and 40, respectively. In this fashion, downward pressure exerted by piston 210 of jack 84 will result in a bending moment being applied to point 92 of strut 66 in a sense opposite to that described in connection with FIGS. 4 through 7. The resulting more positive camber may be measured by conventional gages until the desired degree is obtained.

In both of the instances described in connection with the rear end of a Volkswagen, by way of example, the single clamp member 74 has served as a strut support for both positive and negative camber corrections. This is made possible due primarily to the particular design of the wheel alignment and support members of this particular automobile, and may be equally adaptable to other makes and models, as will be apparent to a person of ordinary skill in the art. Alternatively, the individual upward and downward strut supports 30 and 18 of FIGS. 1 and 2 may be necessary, depending upon the particular configuration of components for the automobile under consideration, as again will be apparent to an ordinarily skilled mechanic.

It should also be noted in connection with this embodiment that in lieu of clamping member 72, a chain or the like may be positioned around the axle 68 for supportive purposes without departing from the spirit and scope of the present invention. To this end, the threaded apertures 186 and 188 and associated holding rings or members 190 and 194 may prove useful.

Although described in connection with the front and rear end of two specific automobiles, it should be clear that the method and apparatus of the present invention may be extended just as usefully to many other automobiles. The only apparatus which need be modified from model to model would be the particular wheel holders and/or strut holders necessary to brace the wheel and struts, respectively. FIGS. 10 through 17 illustrate by way of example other designs of strut holders and/or wheel holders which may be utilized within the context of the present invention.

Figure 10:
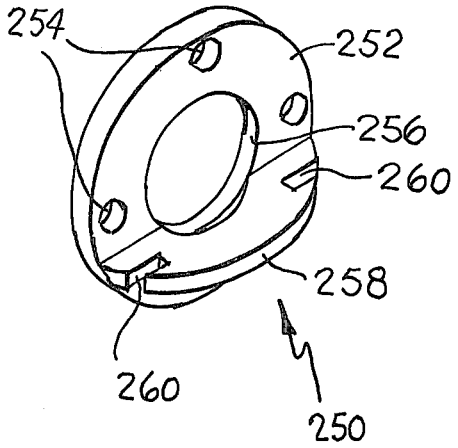
FIG. 10 is a perspective view illustrating one possible embodiment of a wheel holder component in accordance with the teachings of the present invention.

Referring now to FIG. 10, indicated generally by the reference numeral 250 is a wheel holder which is particularly designed for a Datsun 240Z and 260Z as well as the 510 station wagon, and is seen to be comprised of a substantially circular ring plate portion 252 which has a plurality of drum mounting apertures 254 formed therein. A central hole 256 for the hub is also provided as is a substantially horizontally positionable jack thrust member 258 having a pair of opposed slots 260 for receiving a chain or like auxiliary holding device.

Figure 11:
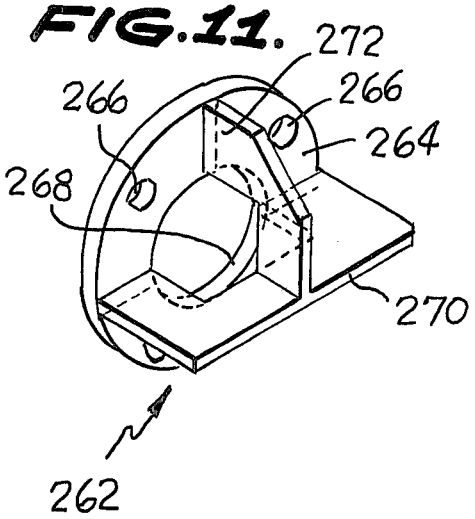
FIG. 11 is a perspective view of an alternative embodiment of a wheel holder component in accordance with the teachings of the present invention.

FIG. 11 illustrates a wheel holder 262 which may be used for Audi automobiles and is seen to comprise a substantially circular ring plate 264 having a plurality of wheel drum mounting holes 266 formed therein through which the threaded bolts of the drum may extend. A central aperture 268 is formed which accomodates the hub of the automobile. Extending between opposite sides of ring 264 is a U-shaped planar thrust support plate 270 whose lower surface is adapted to be engaged by the strut bending jack (not shown). An angled member 272 is positioned transversely to thrust support plate 270 and is connected from its mid-point to the upper portion of ring member 264 to provide additional support to plate 270, as well as add to the bending forces provided by the jack.

Figure 12:
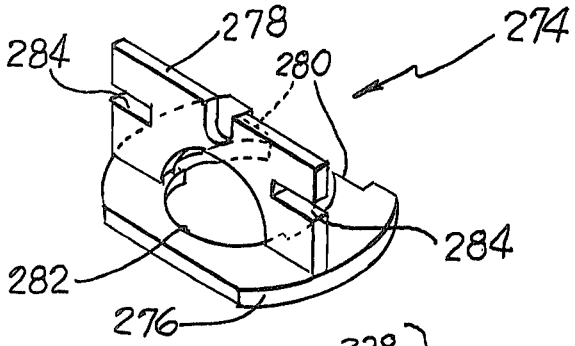
FIG. 12 is a perspective view of a strut holder component which may be utilized in accordance with the teachings of the present invention.

Referring now to FIG. 12, reference number 274 indicates generally a strut holder for a McPherson strut which is similar to the above-described strut holder 18, but which is particularly designed for Datsun models 260Z and 510 station wagon. Strut holder 274 includes a strut bearing plate 276 which in use is substantially vertically oriented, and a transversely positioned support plate 278 against which the support jack (not shown) bears. Strut bearing plate 276 is provided with a central cutout 282 to accomodate the lower ball joint and lower arm of the automobile, cutout 282 terminating in a pair of notches 280 formed for accomodating and bearing against the lower nuts of the McPherson strut. Finally, support plate 278 may be provided with a pair of symmetrical opposed notches 284 which are provided for receiving auxiliary holding means, such as a chain, or the like.

Figure 13:
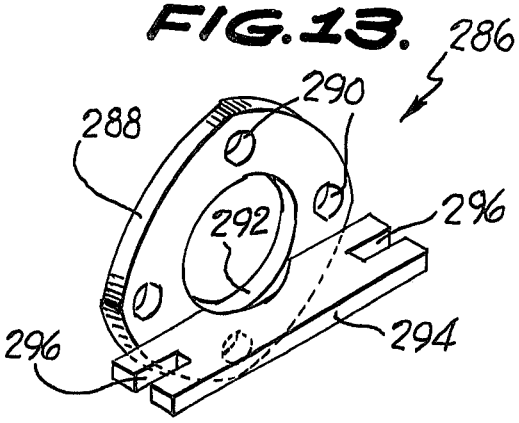
FIG. 13 is yet another alternative embodiment of a possible wheel holder component that may be utilized in accordance with the teachings of the present invention.

Reference numeral 286 in FIG. 13 indicates generally a wheel holder designed for use in conjunction with a Porsche automobile. Wheel holder 286 includes a non-circular ellipsoid shaped member 288 having a plurality of mounting apertures 290 formed thereabout and a hub hole 292 centrally provided therein. A jack support plate 294 extends transversely from the lower portion of ring 288 and is provided with a pair of chain-receiving notches 296.

Figure 14:
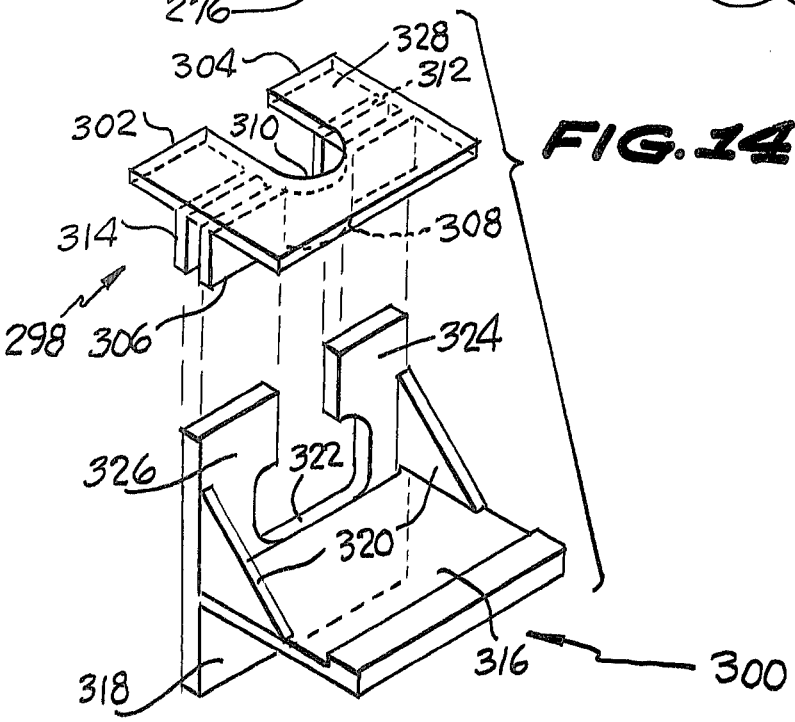
FIG. 14 illustrates in a perspective view a two-part strut holder component which may be utilized on certain automobiles in accordance with the teachings of the present invention.

Referring now to FIG. 14, there is illustrated a two part strut holder which may be utilized on a Porche in combination with a wheel holder 286 of FIG. 13. The strut holder illustrated in FIG. 14 comprises a strut support member indicated generally by the reference numeral 298 and a jack support member indicated generally by the reference numeral 300. Strut support member 298 comprises a planar plate 302 which has centrally formed therein a U-shaped cutout 304 through which the strut of the Porche automobile passes. Transversely positioned with respect to plate 302 is a connecting plate 306 having a central concave portion 308 which corresponds to the central concave portion of cutout 304 on plate 302. Positioned above connecting plate 306 on either side of the U-shaped cutout 304 are a pair of connecting plates 312 and 314 which are substantially parallel to the underlying portions of connecting plate 306.

The jack support member 300 of the Porche strut holder illustrated in FIG. 14 comprises a horizontal planar jack support member 316 which is transversely connected with respect to a vertical support member 318 via a pair of triangular support struts 320. Vertical support plate 318 is provided with an opening 322 to accommodate the lower horizontal strut of the Porche automobile. Opening 322 terminates in a pair of upstanding flanges 324 and 326 about which are attached the plates 312, 314 and 306 of strut support member 298. Reference numeral 328 indicates the bearing surface of strut support member 298 for supporting the strut once the strut holder is assembled and in position, the jack support being positionable on the underside of plate 316.

Referring now to FIGS. 15 through 17, there is illustrated a two-piece strut holder for an Audi automobile which may be utilized in connection with the wheel holder 262 illustrated in FIG. 11. The strut holder for this particular automobile comprises a base member indicated generally by the reference numeral 330 and a strut holding member indicated generally by the reference numeral 332. Base member 330 comprises a planar base portion 334 to which are connected a pair of upstanding vehicle support members 336 and 338. A pair of L-shaped prongs 340 and 342 are connected to the inside edges of upstanding vehicle supports 336 and 338, prongs 340 and 342 terminating in a pair of inwardly extending horizontal flanges 344 and 346.

The strut holding member 332 comprises a pair of substantially parallel connector plates 348 and 350 which are joined at their mid-point which is indicated by reference numeral 352. Plate 348 has extending upwardly from an edge thereof a flange 354 which, in use, bears against the topmost portion of upstanding vehicle supports 336 and 338 of base member 330 (FIG. 17).

Positioned centrally on the upper connector plate 348 and bearing against the upstanding flange 354 is a U-shaped bracket 356 for supporting the strut 360 of the automobile. A circular apertured plug 358 is positioned in a planar base portion 334 of base member 330 for accomodating the lower arm 362 of the automobile (FIG. 17), axle 366 and the wheel drum and hub 364 also being indicated in their supported position in FIG. 17.

It is seen that I have provided a novel and unique method and apparatus for correcting wheel alignment problems by bending the struts or wheel support members of the automobiles that does not require disassembly, permits bent or otherwise deformed struts to be re-aligned for reuse, may be quickly and easily utilized and extended to a number of different automobiles which are prone to the types of misalignment problems hereinabove described.

Obviously, numerous modifications and variations of the present invention are possible in light of the above teachings. It is therefore to be understood that within the scope of the appended claims, the invention may be practiced otherwise than as specifically described herein.

I claim:

1. Apparatus, which comprises:

means for holding a strut of a vehicle having a wheel drum, a hub projecting through said drum, and a strut connected to said hub; and bending means operatively connected to said wheel drum but not contacting said strut for bending said strut while installed in said vehicle.

2. The strut bending apparatus as set forth in claim 1, wherein said wheel drum includes threaded bolts projecting therethrogh, and wherein said bending means comprises wheel holder means coupled to said threaded bolts and means for applying a force to said wheel holder means.

3. The strut bending apparatus as set forth in claim 2, wherein said wheel holder means comprises a wheel plate member having apertures formed therein through which said threaded bolts may be secured, and thrust plate means extending substantially transversely to said wheel plate member for receiving the force applied by said force applying means.

4. The strut bending apparatus as set forth in claim 1, wherein said strut comprises a substantially cylindrical tube.

5. Apparatus, which comprises:

means for holding a strut of a vehicle having a wheel drum, a hub projecting through said drum, and a strut connected to said hub;

bending means operatively connected to said wheel drum for bending said strut while installed in said vehicle;

wherein said wheel drum includes threaded bolts projecting therethrough, and wherein said bending means comprises wheel holder means coupled to said threaded bolts and means for applying a force to said wheel holder means;

wherein said wheel holder means comprises a wheel plate member having apertures formed therein through which said threaded bolts may be secured, and thrust plate means extending substantially transversely to said wheel plate member for receiving the force applied by said force applying means; and wherein said force applying means comprises a jack positioned below said thrust plate means, said jack having piston means for bearing upwardly against said thrust plate means.

6. The strut bending apparatus as set forth in claim 5, wherein said strut holding means comprises means contacting the lower portion of said strut for preventing upward movement thereof.

7. The strut bending apparatus as set forth in claim 6, wherein said contacting means comprises a substantially U-shaped bracket member having an upper inclined portion positionable about said lower portion of said strut, and a pair of downwardly depending leg portions which are respectively secured to a substantially fixed base member.

8. The strut bending apparatus as set forth in claim 7, further comprising a second clamping member secured between the distal end of said lower arm and said substantially fixed base member.

9. Apparatus, which comprises:

means for holding a strut of a vehicle having a wheel drum, a hub projecting through said drum, and a strut connected to said hub;

bending means operatively connected to said wheel drum for bending said strut while installed in said vehicle;

wherein said wheel drum includes threaded bolts projecting therethrough, and wherein said bending means comprises wheel holder means coupled to said threaded bolts and means for applying a force to said wheel holder means;

wherein said wheel holder means comprises a wheel plate member having apertures formed therein through which said threaded bolts may be secured, and thrust plate means extending substantially transversely to said wheel plate member for receiving the force applied by said force applying means; and wherein said force applying means comprises a jack positioned above said thrust plate means, said jack having piston means for bearing downwardly against said thrust plate means.

10. Apparatus, which comprises:

means for holding a strut of a vehicle having a wheel drum, a hub projecting through said drum, and a strut connected to said hub;

bending means operatively connected to said wheel drum for bending said strut while installed in said vehicle;

wherein said wheel drum includes threaded bolts projecting therethrough, and wherein said bending means comprises wheel holder means coupled to said threaded bolts and means for applying a force to said wheel holder means;

wherein said wheel holder means comprises a wheel plate member having apertures formed therein through which said threaded bolts may be secured, and thrust plate means extending substantially transversely to said wheel plate member for receiving the force applied by said force applying means; and wherein said strut holding means comprises means contacting the lower portion of said strut for preventing downward movement thereof.

11. The strut bending apparatus as set forth in claim 10, wherein said contacting means comprises bracket means having a cutout formed therein for fitting about the lower ball joint and lower arm of said automobile, and a jack placed under said bracket means and having a piston for exerting an upward force on said bracket means.

12. The strut bending apparatus as set forth in claim 11, wherein said bracket means comprises a vertically oriented substantially flat plate in which said cutout is formed, said plate having a pair of upstanding ears positioned on each side of said cutout for contacting said strut, and a horizontally oriented support plate against the underside portion of which said piston of said jack is positioned.

13. The strut bending apparatus as set forth in claim 12, wherein said force applying means comprises a second jack positioned above said thrust plate means, said second jack having piston means for bearing downwardly against said thrust plate means.

14. The strut bending apparatus as set forth in claim 13, further comprising means for supporting said second jack above said thrust plate means.

15. The strut bending apparatus as set forth in claim 14, wherein said supporting means comprises a horizontal brace member having arms extending downwardly from the ends thereof and secured to a substantially fixed base member, said second jack having its base positioned on the underside of said horizontal brace.

16. The strut bending apparatus as set forth in claim 15, further comprising a second clamping member secured between the distal end of said lower arm and said substantially fixed base member.

17. Apparatus, which comprises:

means for holding a strut of a vehicle having a wheel drum, a hub projecting through said drum, and a strut connected to said hub;

bending means operatively connected to said wheel drum for bending said strut while installed in said vehicle;

wherein said wheel drum includes threaded bolts projecting therethrough, and wherein said bending means comprises wheel holder means coupled to said threaded bolts and means for applying a force to said wheel holder means;

wherein said wheel holder means comprises a wheel plate member having apertures formed therein through which said threaded bolts may be secured, and thrust plate means extending substantially transversely to said wheel plate member for receiving the force applied by said force applying means; and wherein said strut holding means comprises clamping means positionable about the axle of said wheel for preventing either downward or upward movement thereof.

18. The strut bending apparatus as set forth in claim 17, wherein said clamping means comprises a substantially U-shaped jaw member having a pair of downwardly depending legs extending from the ends thereof.

19. The strut bending apparatus as set forth in claim 18, further comprising a substantially planar base member to which said pair of legs are affixed at the distal ends thereof.

20. The strut bending apparatus as set forth in claim 19, said clamping means further comprising a concave clamp member and means for urging said concave clamp member upwardly.

21. The strut bending apparatus as set forth in claim 20, wherein said urging means comprises a jack positioned on said base and having a piston contacting the underside of said concave clamp member.

22. The strut bending apparatus as set forth in claim 21, wherein said concave clamp member includes a pair of flanges extending laterally and outwardly therefrom, said U-shaped jaw member having vertical apertured guides for adjustably receiving said pair of flanges.

23. The strut bending apparatus as set forth in claim 22, wherein said force applying means comprises a second jack positioned above said thrust plate means, said second jack having piston means for bearing downwardly against said thrust plate means.

24. The strut bending apparatus as set forth in claim 23, further comprising means for supporting said second jack above said thrust plate means.

25. The strut bending apparatus as set forth in claim 24, wherein said supporting means comprises a horizontal brace member having arms extending downwardly from the ends thereof and secured to said substantially planar base member, said second jack having its base positioned on the underside of said horizontal brace.

26. The strut bending apparatus as set forth in claim 25, further comprising a second clamping member secured between the distal end of said axle and said base member.

27. The strut bending apparatus as set forth in claim 22, wherein said force applying means comprises a second jack positioned below said thrust plate means, said second jack having piston means for bearing upwardly against said thrust plate means.

28. The strut bending apparatus as set forth in claim 27, further comprising a second clamping member secured between the distal end of said axle and said base member.

29. A method of correcting misalignment by bending a strut of a vehicle which includes a wheel supporting hub, a wheel drum through which said hub extends, and a frame, said strut being connected between said hub and said frame, which comprises the steps of:

holding said strut at a point adjacent the portion thereof to be bent; and applying a bending force to that portion of said hub which extends through said wheel drum by mounting a holding device onto said wheel drum and operating jack means so as to exert pressure on said wheel drum holding device.

30. The method of bending a vehicle strut as set forth in claim 29, wherein said holding step includes the steps of placing a strut clamping member underneath said strut around the lower ball joint and arm of said vehicle and operating a support jack so as to urge said strut clamping member upwardly against said strut.

31. The method of bending a vehicle strut as set forth in claim 30, further comprising the step of positioning said jack means so as to exert downward pressure on said wheel drum holding device.

32. The method of bending a vehicle strut as set forth in claim 29, wherein said holding step includes the steps of placing a strut clamping member about the base of said strut and fastening the distal end of said strut clamping member to a substantially planar fixed base member.

33. The method of bending a vehicle strut as set forth in claim 32, further comprising the step of positioning said jack means so as to exert upward pressure on said wheel drum holding device.

34. The method of bending a vehicle strut as set forth in claim 29, wherein said hub extends from an axle of said vehicle, and wherein said holding step includes the steps of clamping said axle at a point adjacent said strut against both upward and downward forces.

35. The method of bending a vehicle strut as set forth in claim 34, further comprising the step of positioning said jack means so as to exert downward pressure on said wheel drum holding device.

36. The method of bending a vehicle strut as set forth in claim 35, further comprising the step of claimping said axle at its distal end.

37. The method of bending a vehicle strut as set forth in claim 34, further comprising the step of positioning said jack means so as to exert upward pressure on said wheel drum holding device.

38. The method of bending a vehicle strut as set forth in claim 36, further comprising the step of clamping said axle at its distal end.

39. Strut bending apparatus for a vehicle having a wheel hub and a substantially tubular strut connected to said hub, which comprises:

means adapted to be positioned adjacent said strut for holding said strut against movement in a selected direction;

holder means operatively connected to said strut and means not contacting said strut for bending said strut by applying a bending force in substantially said selected direction to said holder means.

40. The strut bending apparatus as set forth in claim 39, wherein said vehicle further includes threaded bolts to which a wheel is adapted to be secured, and wherein said holder means includes aperture means for securing same to said threaded bolts.

41. The strut bending apparatus as set forth in claim 40, wherein said vehicle further includes a wheel drum through which said hub and said threaded bolts are adapted to be secured, and wherein said holder means comprises a wheel holder adapted to be affixed to said wheel drum.

42. The strut bending apparatus as set forth in claim 41, wherein said wheel holder comprises a wheel plate having said aperture means formed therein and a thrust plate extending substantially transversely to said wheel plate for receiving the force applied by said bending means.

* * * * *